US008595892B1

(12) United States Patent
Everette, Jr.

(10) Patent No.: US 8,595,892 B1
(45) Date of Patent: Dec. 3, 2013

(54) ULTRASONIC FLOOR CLEANER AND SCRUBBER

(76) Inventor: Wilson E. Everette, Jr., Ellenwood, GA (US)

( * ) Notice: Subject to any disclaimer, the term of this patent is extended or adjusted under 35 U.S.C. 154(b) by 538 days.

(21) Appl. No.: 12/848,993

(22) Filed: Aug. 2, 2010

(51) Int. Cl.
*A47L 7/00* (2006.01)

(52) U.S. Cl.
USPC ..... 15/320; 15/319; 15/321; 15/323

(58) Field of Classification Search
USPC ..... 15/319, 320, 321, 323
See application file for complete search history.

(56) References Cited

U.S. PATENT DOCUMENTS

| | | | | |
|---|---|---|---|---|
| 4,069,541 | A * | 1/1978 | Williams et al. | 15/321 |
| 4,103,519 | A | 8/1978 | Davidson | |
| 4,307,484 | A | 12/1981 | Williams | |
| 4,756,048 | A | 7/1988 | Kauffeldt et al. | |
| 5,279,672 | A * | 1/1994 | Betker et al. | 134/18 |
| 6,279,196 | B2 * | 8/2001 | Kasen et al. | 15/320 |
| 7,228,590 | B2 | 6/2007 | Bosses | |
| 2003/0101532 | A1 * | 6/2003 | Desinger et al. | 15/321 |
| 2004/0040102 | A1 * | 3/2004 | Field et al. | 15/50.1 |
| 2006/0179599 | A1 * | 8/2006 | Miner et al. | 15/320 |
| 2008/0134459 | A1 * | 6/2008 | Chugun | 15/320 |
| 2009/0044844 | A1 | 2/2009 | Sakurai et al. | |

* cited by examiner

*Primary Examiner* — Lee D Wilson
*Assistant Examiner* — Shantese McDonald
(74) *Attorney, Agent, or Firm* — Crose Law LLC; Bradley D. Crose

(57) ABSTRACT

An ultrasonic cleaner and scrubber is disclosed. The cleaner and scrubber includes a housing, dispenser reservoirs disposed within the housing and configured to hold at least one dispense liquid, collection reservoirs disposed within the housing and configured to hold at least one collected liquid, at least one dispenser port through which to dispense the held dispense liquid, an ultrasonic waveform emitter disposed upon an underside of the housing to provide ultrasonic waves to a floor surface at a user-selected frequency and at a user-selected intensity to vibrate the dispense liquid, once dispensed from the dispenser port, within and upon the floor surface to clean the floor surface, at least one suction and liquid and debris collection port, and a control panel handle disposed upon the housing and with which to hold and move the cleaner and scrubber and through which to access controls for use.

17 Claims, 12 Drawing Sheets

ULTRASONIC FLOOR CLEANER AND SCRUBBER

FIELD OF THE INVENTION

The technology described herein relates generally to floor cleaners and scrubbers. More specifically, the technology relates to an ultrasonic floor cleaner and scrubber utilizing ultrasonic waves and biodegradable cleaning solutions for a multiplicity of floor surfaces.

BACKGROUND OF THE INVENTION

Ultrasound is recurring sound pressure. Ultrasound operates at a frequency greater than what the human ear can hear. Typically, this frequency is approximately 20 kHz. Therefore, ultrasound generally operates at frequencies greater than 20 kHz. Ultrasound is produced for use in many different endeavors and areas of commerce. Generally ultrasound is used to penetrate a particular medium and measure the reflection signature or supply focused energy.

Ultrasound has been used is some devices and methods for cleaning. By way of example, in this application, ultrasound is created by generators which produce high frequency electricity. This high frequency electricity is then converted to mechanical energy or sound waves through a transducer, which actually makes these waves vibrate.

Known patents include the following: U.S. Pat. No. 4,103,519, issued to Davidson on Aug. 1, 1978, discloses an apparatus for ultrasonic cleaning of carpet, upholstery, and similar materials. U.S. Pat. No. 4,307,484, issued to Williams on Dec. 29, 1981, discloses a cleaning apparatus and method. U.S. Pat. No. 4,756,048, issued to Kauffeldt et al. on Jul. 12, 1988, discloses a device for cleaning large-area textile coverings especially carpets and carpeted floors. U.S. Pat. No. 7,228,590, issued to Bosses on Jun. 12, 2007, discloses an extractor including a sonic agitator.

Known published patent applications include the following: U.S. Patent Application Publication No. 2003/0101532, filed by Desinger et al. and published on Jun. 5, 2003, discloses a wall and floor cavitation cleaner. U.S. Patent Application Publication No. 2009/0044844, filed by Sakurai et al. and published on Feb. 19, 2009, discloses an ultrasonic cleaning apparatus. U.S. Patent Application Publication No. 2003/0101532, filed by Desinger et al. and published on Jun. 5, 2003, discloses a wall and floor cavitation cleaner.

The foregoing patent and other information reflect the state of the art of which the inventor is aware and are tendered with a view toward discharging the inventor's acknowledged duty of candor in disclosing information that may be pertinent to the patentability of the technology described herein. It is respectfully stipulated, however, that the foregoing patent and other information do not teach or render obvious, singly or when considered in combination, the inventor's claimed invention.

BRIEF SUMMARY OF THE INVENTION

In various exemplary embodiments, the technology described herein provides an ultrasonic floor cleaner and scrubber utilizing ultrasonic waves and biodegradable cleaning solutions for a multiplicity of floor and other surfaces.

In one exemplary embodiment, the technology described herein provides an ultrasonic floor cleaner and scrubber. The ultrasonic floor cleaner and scrubber includes: a housing; a plurality of dispenser reservoirs disposed within the housing and configured to hold at least one dispense liquid; a plurality of collection reservoirs disposed within the housing and configured to hold at least one collected liquid; at least one dispenser port through which to dispense the held dispense liquid; an ultrasonic waveform emitter disposed upon an underside of the housing to provide ultrasonic waves to a floor surface at a user-selected frequency and at a user-selected intensity to vibrate the dispense liquid, once dispensed from the dispenser port, within and upon the floor surface to clean the floor surface; at least one suction and liquid and debris collection port; and a control panel handle disposed upon the housing and with which to hold and move the cleaner and scrubber and through which to access controls for use. In at least one embodiment, the dispense liquid is a biodegradable cleaning solution.

In at least one embodiment, the ultrasonic floor cleaner and scrubber also includes a steam generation assembly disposed within the housing and configured to eject steam out at least one steam ejection port.

In at least one embodiment, the ultrasonic floor cleaner and scrubber further includes an agitation assembly disposed upon an underside of the housing to agitate the dispensed liquid within and upon the floor surface to clean the floor surface. In one embodiment, the agitation assembly includes a plurality of rotatable suction brush heads. In an alternative embodiment, the agitation assembly includes a plurality of rollers.

In at least one embodiment, the ultrasonic floor cleaner and scrubber also includes: a first liquid retrieval assembly to remove major debris and liquids to a first collection reservoir of the plurality of collection reservoirs; and a second liquid retrieval assembly to remove remaining finer debris and liquids to a second collection reservoir of the plurality of collection reservoirs.

In at least one embodiment, the ultrasonic floor cleaner and scrubber further includes an extendable hand wand fluidly coupled to the ultrasonic floor cleaner and scrubber with which to clean and scrub surfaces other than those directly beneath the housing.

In at least one embodiment, the ultrasonic floor cleaner and scrubber also includes: a power source; and a power level indicator.

In another exemplary embodiment, the technology described herein provides a portable ultrasonic cleaner and scrubber. The portable ultrasonic cleaner and scrubber includes: a transportable housing pack having a carrying strap to carry the pack and a battery pack power source disposed within; at least one dispenser reservoir disposed within the housing pack and configured to hold at least one dispense liquid; an extendable hand wand fluidly coupled to the housing pack with a flexible hose and through which the at least one dispense liquid travels; at least one dispenser port disposed upon the end of the hand wand through which to dispense the dispense liquid; an ultrasonic waveform emitter disposed upon an end of the hand wand to provide ultrasonic waves to a surface at a user-selected frequency and at a user-selected intensity to vibrate the dispense liquid, once dispensed from the dispenser port, within and upon the surface to clean the surface; and at least one suction and liquid and debris collection port disposed upon the end of the hand wand.

In at least one embodiment, the portable ultrasonic cleaner and scrubber also includes a steam generation assembly disposed within the housing pack and configured to eject steam out at least one steam ejection port upon the end of the hand wand.

In at least one embodiment, the portable ultrasonic cleaner and scrubber further includes a handgrip disposed upon the extendable hand wand. The handgrip includes a plurality of controls by which to control the portable ultrasonic cleaner and scrubber and with which to adjust a plurality of configurable settings.

In at least one embodiment, the portable ultrasonic cleaner and scrubber further includes at least one collection reservoir disposed within the housing pack and configured to hold at least one collected liquid and debris.

In at least one embodiment, the portable ultrasonic cleaner and scrubber also includes a pass-through adapter to fluidly couple the portable ultrasonic cleaner and scrubber to an external collection reservoir such that any liquid and debris reclaimed by the portable ultrasonic cleaner and scrubber by the suction and liquid collection port passes through to the external collection reservoir.

In at least one embodiment, the portable ultrasonic cleaner and scrubber further includes: a plurality of steam spray nozzles; and a plurality of disinfectant sprayer nozzles.

In at least one embodiment, the portable ultrasonic cleaner and scrubber also includes an agitation assembly disposed upon an underside of the extendable hand wand to agitate the dispensed liquid within and upon the surface to clean the surface.

In yet another exemplary embodiment, the technology described herein provides an extendable hand wand for ultrasonic cleaning and scrubbing. The hand wand includes: a cleaning head disposed upon a distal end of the extendable hand wand; at least one dispenser port disposed upon the cleaning head through which to dispense a liquid; at least one suction and liquid and debris collection port disposed upon the cleaning head; and an ultrasonic waveform emitter disposed upon the cleaning head to provide ultrasonic waves to a surface at a user-selected frequency and at a user-selected intensity to vibrate a cleaning solution within and upon the surface to clean the surface.

In at least one embodiment, the extendable hand wand also includes an agitation assembly disposed upon an underside of the cleaning head to agitate the dispensed liquid within and upon the surface to clean the surface.

In at least one embodiment, the extendable hand wand further includes a plurality of steam spray nozzles; and a plurality of disinfectant sprayer nozzles.

In at least one embodiment, the extendable hand wand also includes an adapter to fluidly couple the extendable hand wand to a cleaner and scrubber to provide ultrasonic cleaning and scrubbing from the extendable hand wand.

Advantageously, the technology described herein provides an ultrasonic cleaning solution that is economically feasible while providing superior surface cleaning. Also advantageously, the technology described herein provides for the use of a cleaner and scrubber utilizing biodegradable cleaning agents.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Figure 1:
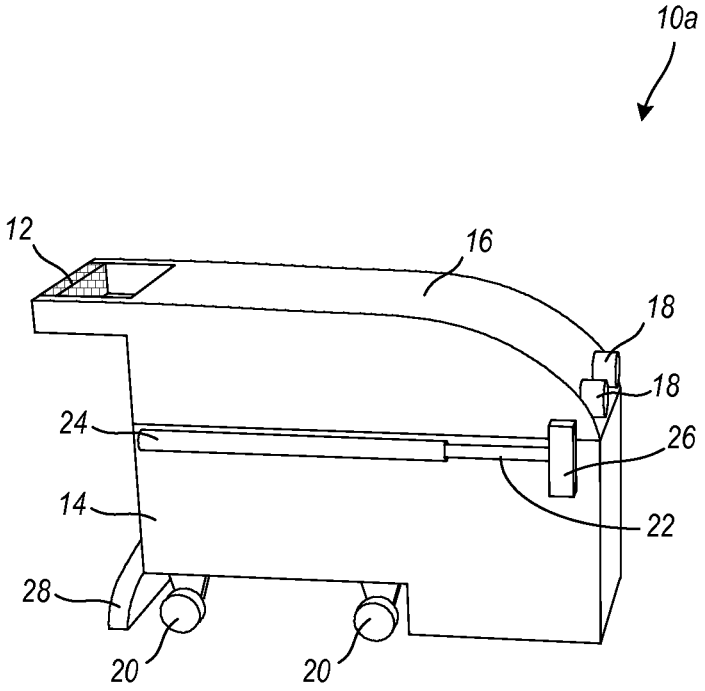
FIG. 1 is a front perspective view of an ultrasonic floor cleaner and scrubber, according to an embodiment of the technology described herein.
Figure 2:
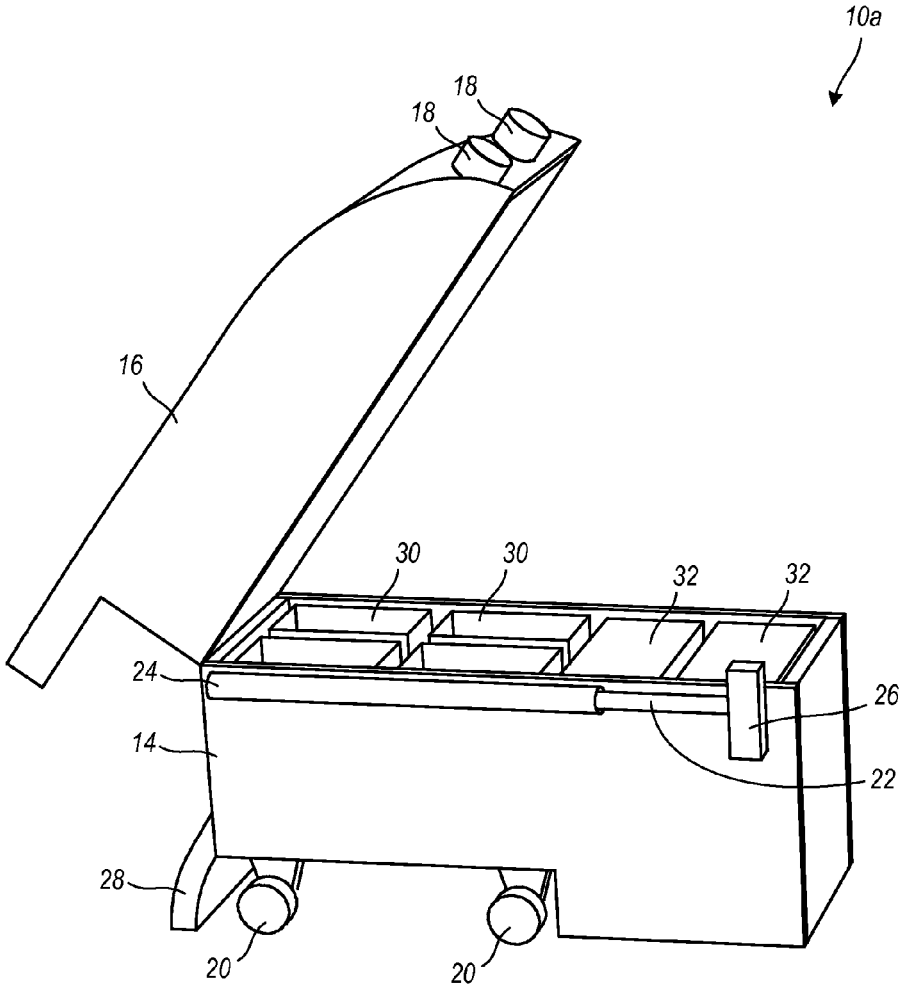
FIG. 2 is a front perspective view of the ultrasonic floor cleaner and scrubber depicted in FIG. 1, illustrating, in particular, an open state and the dispense reservoirs for cleaning solutions, and the like, and the collection reservoirs to hold reclaimed liquids and debris from the cleaned surface, according to an embodiment of the technology described herein.
Figure 3:
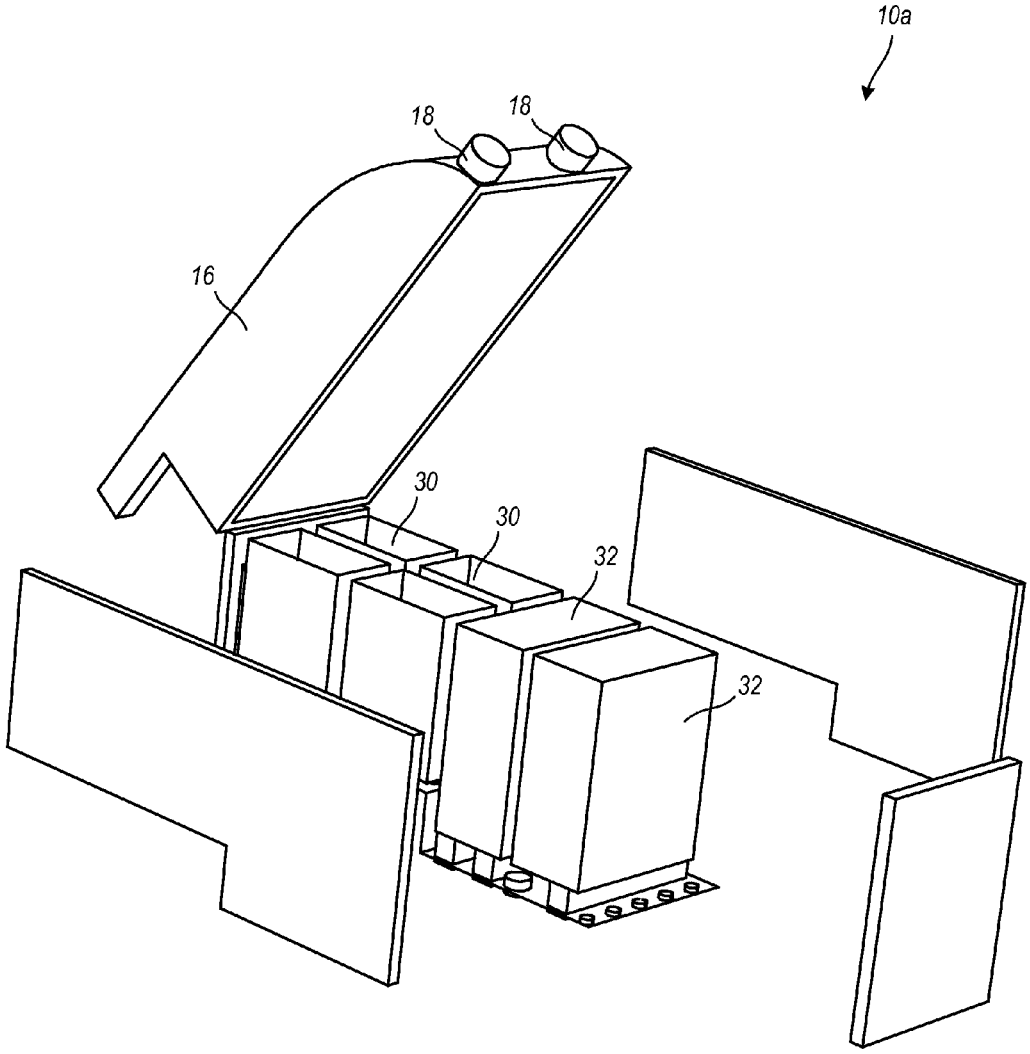
FIG. 3 is an expanded view of the ultrasonic floor cleaner and scrubber depicted in FIG. 1, illustrating, in particular, the dispense reservoirs and the collection reservoirs.
Figure 4:
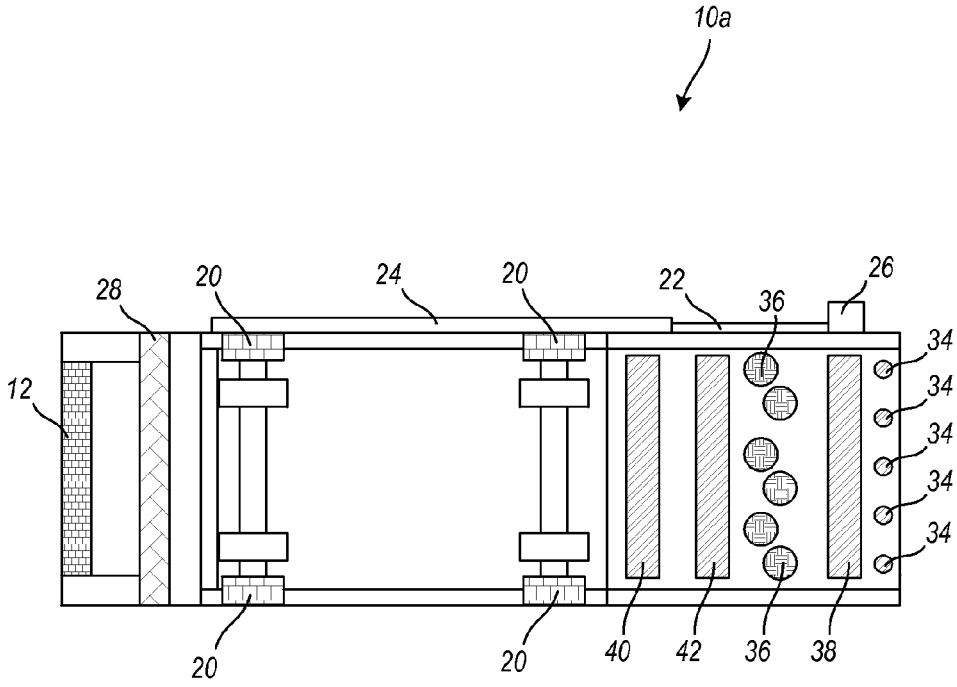
FIG. 4 is a bottom view of the ultrasonic floor cleaner and scrubber depicted in FIG. 1, illustrating, in particular, the removal ports, release ports, an ultrasound waveform emitter, rotating cleaning heads, and suction ports, according to an embodiment of the technology described herein.

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides an ultrasonic cleaner and scrubber and extendable hand wand utilizing ultrasonic waves and biodegradable cleaning solutions for a multiplicity of floor and other surfaces.

Because the ultrasonic cleaner and scrubber utilizes ultrasound and biodegradable cleaning liquids it is useful in a multiplicity of commercial and residential applications. By way of example, the ultrasonic cleaner and scrubber is helpful for floor and other surface cleaning in hospitals, emergency rooms, daycares, nurseries, military buildings and properties, animal hospitals, food preparation facilities, meat-packing plants, seafood plants, slaughter houses, centers for disease control, mobile MASH units, restaurant kitchens, auto repair facilities, rooms adjacent to clean rooms, cosmetic facilities, prescription drug preparation facilities, residential applications, pharmaceutical facilities, penal institutions, medical facilities, mental health facilities, hazardous materials remediation companies, and the like.

Referring now to the Figures, an ultrasonic floor cleaner and scrubber 10 is shown. As will be described in detail subsequently, four versions are depicted 10*a*, 10*b*, 10*c*, a standard version 10*a*, mini version 10*b*, portable version 10*c*, and small residential version 10*d*. A commercial model is available in the same configuration as the residential model, but constructed of sturdier components to with stand heavier use.

The components of the ultrasonic floor cleaner and scrubber 10 in all embodiments disclosed are preferably modular in construction as much as possible. This provides for easy replacement of damaged or worn components. This also provides for the easy replacement of upgraded components.

As depicted specifically in FIGS. 1 through 6, ultrasonic cleaner and scrubber 10*a* includes a housing formed generally by base section 14 and upper section 16. The upper section 16 can be lifted by an operator to allow internal access, as depicted specifically in FIG. 2.

The ultrasonic floor cleaner and scrubber 10*a* includes a multiplicity of wheels 20 upon which the apparatus is moved while cleaning floor and other surfaces. The wheels 20 also provide for easy transportability of the device.

The ultrasonic floor cleaner and scrubber 10*a* includes lights 18 for use when present illumination is lacking.

The ultrasonic floor cleaner and scrubber 10*a* includes dispenser reservoirs 32 disposed within the housing. Each dispenser reservoir 32 is configured to hold at least one dispense liquid. By way of example, the dispense liquid is a biodegradable cleaning agent. Other items are dispensed in applications to a surface, such as steam, cleaners, disinfectants, and the like.

The ultrasonic floor cleaner and scrubber 10*a* includes collection reservoirs 30 within the housing. Each collection reservoir 30 is configured to hold at least one collected liquid.

The ultrasonic floor cleaner and scrubber 10*a* includes at least one dispenser port 34 through which to dispense the held dispense liquid. By way of example, a biodegradable cleaning agent is dispensed from dispenser reservoir 32 through dispenser port 34 for application upon a surface such as a floor. The number and location of the dispenser ports 34 can vary. Additionally, the order in which materials are applied, such as steam and the biodegradable cleaning agent can vary.

The ultrasonic floor cleaner and scrubber 10*a* includes an ultrasonic waveform emitter 38. As depicted ultrasonic waveform emitter 38 is disposed upon an underside of the housing. The ultrasonic waveform emitter 38 provides ultrasonic waves to a floor surface at a user-selected frequency and at a user-selected intensity to vibrate the dispense liquid, once dispensed from the dispenser port, within and upon the floor surface to clean the floor or other surface.

The ultrasonic floor cleaner and scrubber 10*a* includes at least one suction and liquid and debris collection port. As depicted, the ultrasonic floor cleaner and scrubber 10*a* includes a first removal port 40 and a second removal port 28. The first removal port 40 is part of the first liquid retrieval assembly to remove major debris and liquids to a first collection reservoir of the plurality of collection reservoirs 30. The second removal port 28 is part of the second liquid retrieval assembly to remove remaining finer debris and liquids to a second collection reservoir 30 of the plurality of collection reservoirs.

The ultrasonic floor cleaner and scrubber 10*a* includes a control panel handle 12. The control panel handle 12 is disposed upon the housing to hold and move the cleaner and scrubber and to access controls for use. By way of example, the control panel handle 12 includes information displays and adjustable controls for auto-level sensors, power levels, diagnostics information, cleaner and disinfectant levels, and the frequencies and intensities of the ultrasound waveforms. Additionally, the control panel handle 12 provides for variable height and speed of the ultrasonic floor cleaner and scrubber 10*a*. Furthermore, the control panel handle 12 provides for variable dispensing output. The control panel handle 12 provides for the selection of a manual mode or a robotic or auto-travel (pulls itself) mode.

Figure 5:
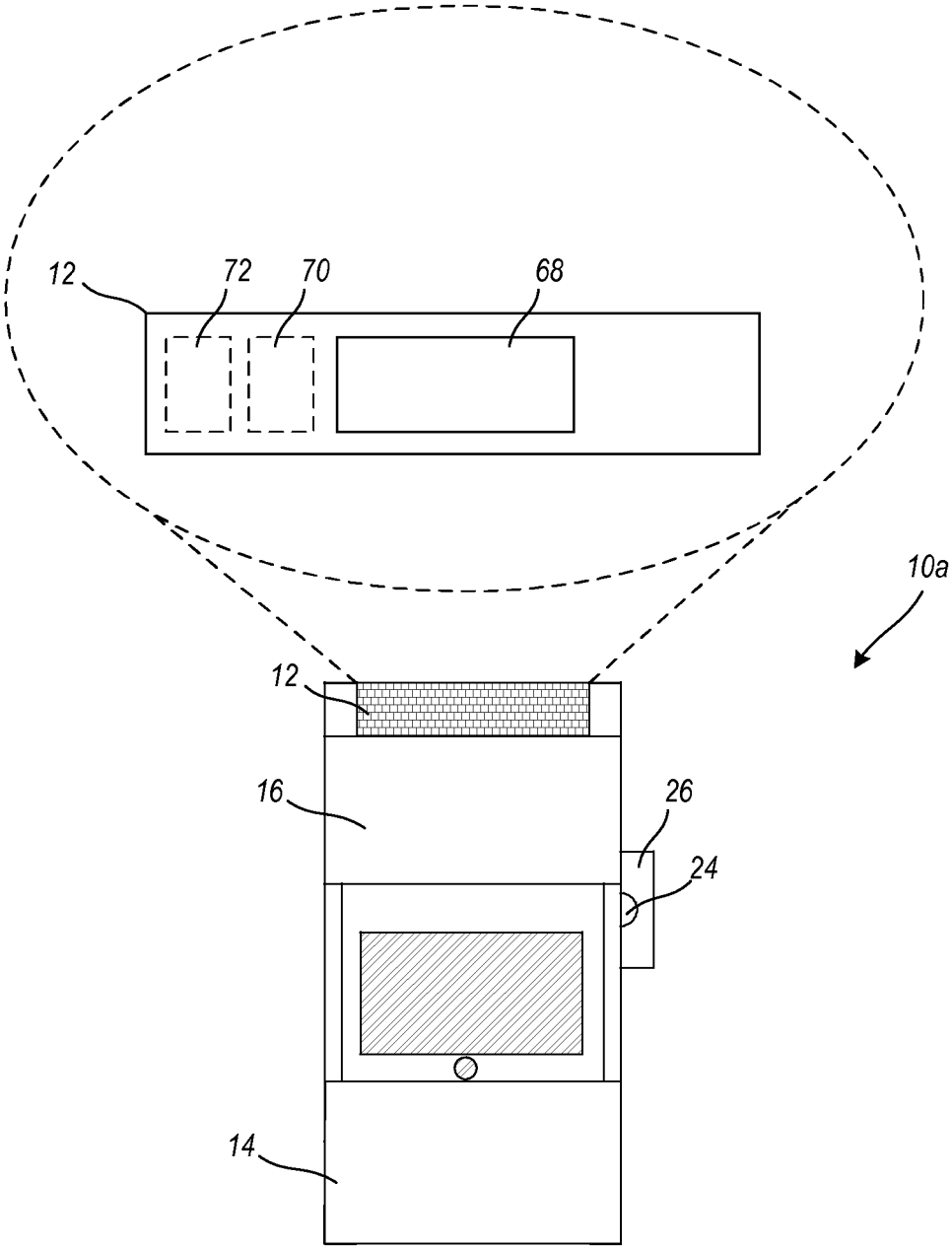
FIG. 5 is rear view of the ultrasonic floor cleaner and scrubber depicted in FIG. 1.
Figure 6:
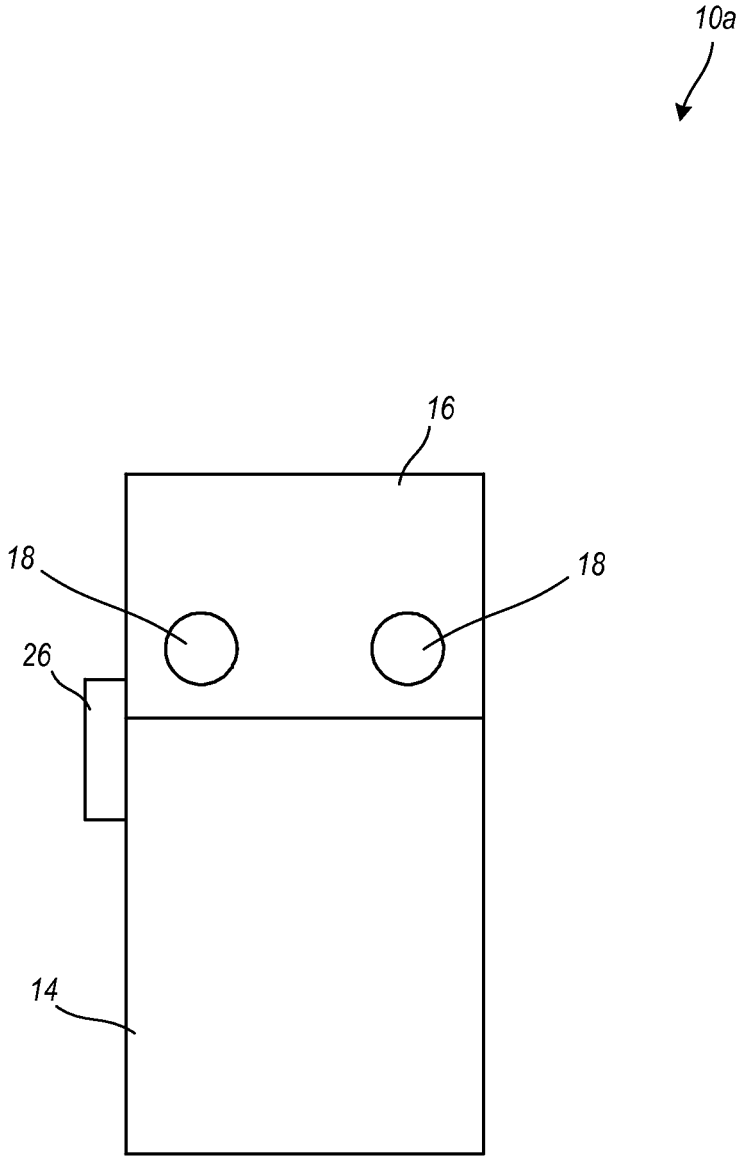
FIG. 6 is a front view of the ultrasonic floor cleaner and scrubber depicted in FIG. 1.

By way of example, and as depicted in FIG. 5, the control handle 12 includes a processor 70 and display 68. The display 68 is preferably an LCD touch screen. The processor 70 provides overall control and onboard automatic self diagnostics of the cleaner 10. The processor 70 provides e-mail connectivity and capability to send notification to the department supervisor of predetermined timed interval maintenance procedures.

By way of example, these timed maintenance procedures are included in the manual, and the sales representative make certain the proper personnel is notified of these procedures. If the necessary timed maintenance procedures are not performed in a certain time period (5 days for example), a second notification is displayed on the LCD screen and e-mailed to departmental supervisor. After the second notice, if the proper maintenance procedures are not performed in a certain time period (2 days for example), the floor cleaner 10 will shut down and cease to function and will need an override code from the manufacturer. This override code is different each time. After the override code is entered, the necessary maintenance procedures will have to be completed within a certain time period (2 hrs for example) for the machine 10 to function. The maintenance functions after completion will have to be checked off on the cleaner mounted LCD touch screen 70, after which the cleaner 10 will return to normal function. Self diagnostics will include onboard automatic self diagnostics capabilities such as ultrasonic wave equipment monitoring, steam generation equipment to insure optimum and safe performance.

By way of example, necessary timed maintenance procedures include, but are not limited to, the following: lubrication of wheel bearings; cleaning, disinfection of brushes, wheels, and nozzles; checking the battery; adjustment of internals, motors, drive system, etc., if necessary; and replacement, repair of damaged, worn parts (heating elements, etc).

Automatic wheels, brushes, waste removal ports steam cleaning, disinfection cycle—this function will be continuous while the cleaner is in use. The cleaner 10 will not move until completing this cleaning cycle before transfer to another location. This feature will prevent the spread/transfer of pathogens, germs, diseases from one location to another. The cleaner 10 should be thoroughly steam cleaned (removable side panels allows easy interior cleaning) in some predetermined time frame, to insure there is no spread of germs, diseases, pathogens.

In at least one embodiment, the ultrasonic floor cleaner and scrubber 10 includes a GPS (Global Positioning System) locator 72. By way of example, this feature is used to locate the cleaner 10 on very large sites or multi building locations. This feature also could be use as a theft deterrent if the cleaner 10 is removed from the premises without permission. The cleaner 10 can be disabled remotely and a locator beep/sound enabled. The cleaner 10 can be located with its internal GPS signal sent by e-mail to the supervisor's computer, hand held device, cell phone, or manufacturer's computer.

The ultrasonic floor cleaner and scrubber 10*a* includes a steam generation assembly disposed within the housing and configured to eject steam out at least one steam ejection port 42. The ejected steam through port 42 is useful in cleaning surfaces and is combined with other cleaning means, such as ultrasonic waveform emissions to provide improved cleaning solutions.

The ultrasonic floor cleaner and scrubber 10*a* includes an agitation assembly disposed upon an underside of the housing to agitate the dispensed liquid within and upon the floor surface to clean the floor surface. In one embodiment, the agitation assembly includes a plurality of rotatable suction brush heads 36, as depicted. In an alternative embodiment, the agitation assembly includes a plurality of rollers.

The ultrasonic floor cleaner and scrubber 10*a* includes an extendable hand wand 22. The extendable hand wand 22 is fluidly coupled to the ultrasonic floor cleaner and scrubber 10*a*. The extendable hand wand 22 provides an operator the ability to clean and scrub surfaces other than those directly beneath the housing. The wand 22 is stored in sleeve 24 when not in use. The wand 22 includes head 26 that contains ports and emitters comparable to the underside of the housing, yet more compact in order to fit on the underside of the head 26.

In at least one embodiment, the ultrasonic floor cleaner and scrubber 10*a* also includes a power source and a power level indicator. Power can be provided by a battery supply or an A/C connection to a traditional power source in a building or home. The battery supply versions are rechargeable.

In at least one embodiment, the ultrasonic floor cleaner and scrubber 10*a* also includes a waste water discharge assembly. As such dispense reservoir bottles are reused to capture waste water for proper disposal. Furthermore, the ultrasonic floor cleaner and scrubber 10*a*, in at least one embodiment, includes a waste water sanitizing assembly to sanitize the reclaimed liquids and debris.

In use, the cleaner 10, in the commercial model, can be used, by way of example, with the following directions:

- All cleaners startup is accomplished by use of the handle mounted LCD touch screen. Power is provided by onboard retractable electrical cord and or rechargeable batteries.
- Startup also includes a self diagnostics mode of all functions, after which the cleaner is ready.
- The cleaner's water, deodorant, bio-degradable cleaner reservoirs should be adequately filled with the required solutions.
- One version of the cleaner is an electrically operated, self propelled and tenant directed model. The unit is transported to a location to be cleaned. At the location, touch the start cleaning cycle icon; push the cleaner across the floor, covering the entire floor surface. When cleaning is finished, touch the stop cleaning icon. The cleaner will continue to operate to clean the wheels, brushes and waste removal port. Push the cleaner over any remaining liquids on the floor.
- The hand wand is used for vertical surfaces. Start the hand wand function with the LCD touch screen. Move the hand wand in an up down pattern, covering the entire surface. When cleaning is finished, touch the hand wand stop icon on the LCD screen.
- One version of the cleaner is the riding model. The riding model also starts up with the onboard LCD touch screen. The riding model power train could be operated by rechargeable electric batteries or LP engine. The cleaner is driven to the location, at the location, touch the start cleaning cycle icon; drive the cleaner across the floor, covering the entire floor surface. When cleaning is finished, touch the stop cleaning icon. The cleaner will continue to operate to clean the wheels, brushes and waste removal port. Drive the cleaner over any remaining liquids on the floor.
- The hand wand is operated in the same manner as above.
- The waste liquids are retrieved from the waste container and properly disposed.

Figure 7:
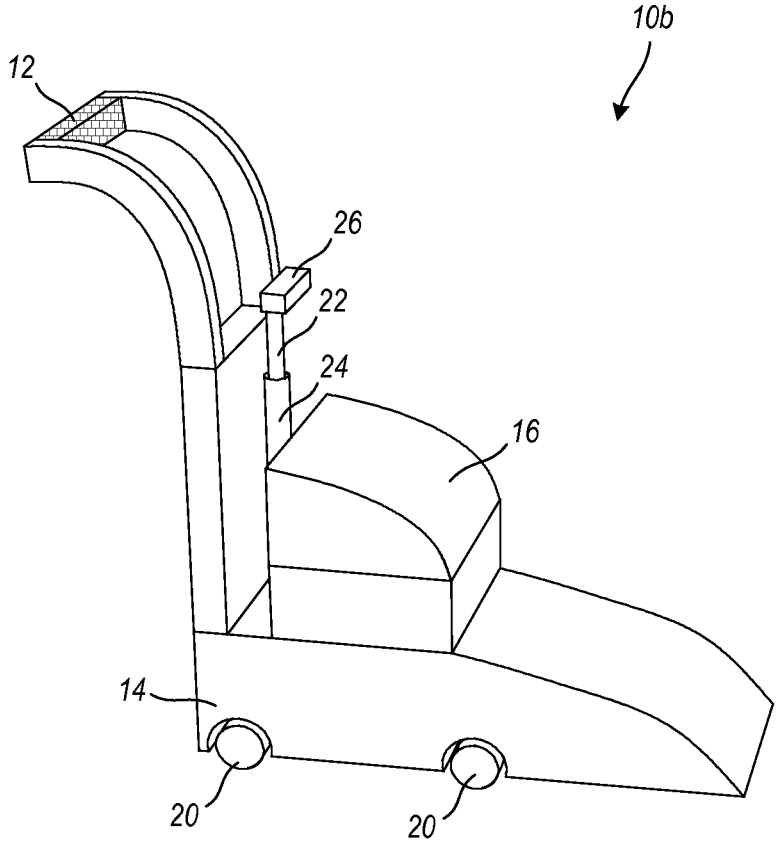
FIG. 7 is a front perspective view of an ultrasonic floor cleaner and scrubber, in a smaller version, according to an alternative embodiment of the technology described herein.
Figure 8:
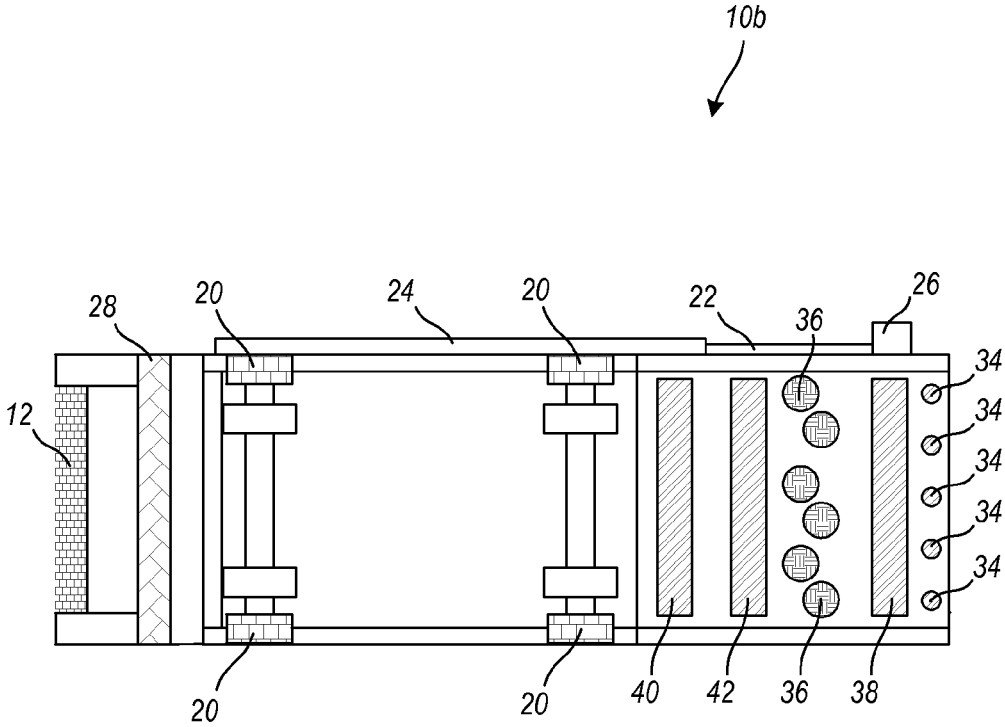
FIG. 8 is a bottom view of the ultrasonic floor cleaner and scrubber depicted in FIG. 7, illustrating, in particular, the removal ports, release ports, an ultrasound waveform emitter, rotating cleaning heads, and suction ports, according to an embodiment of the technology described herein.
Figure 10:
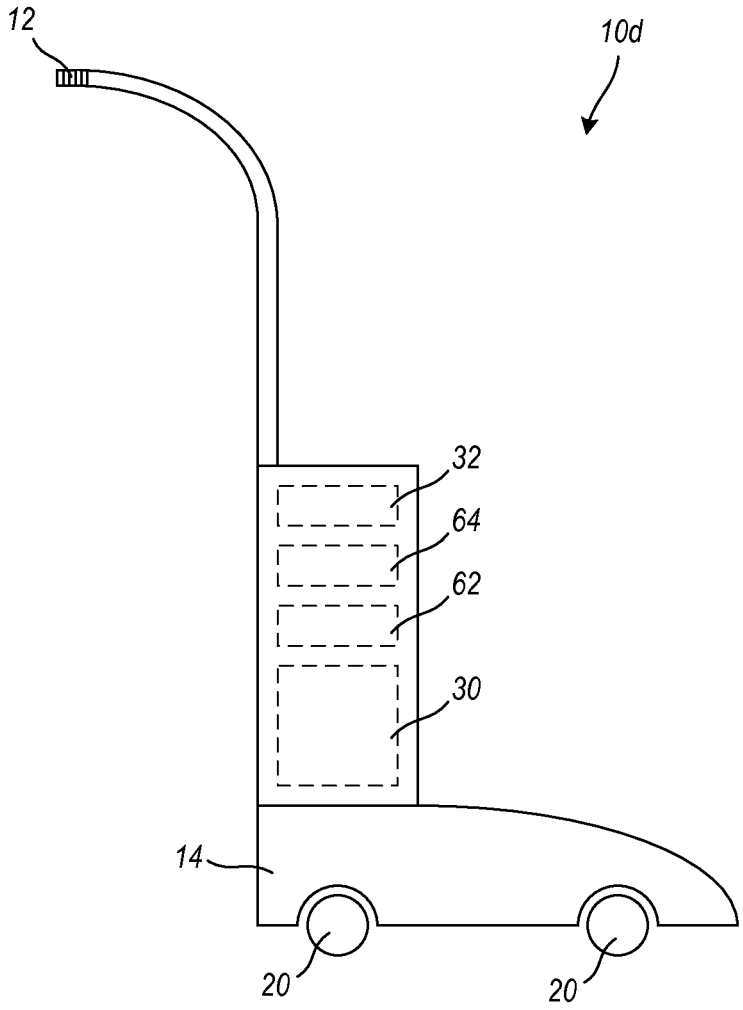
FIG. 10 is a front perspective view of an ultrasonic floor cleaner and scrubber, in a smaller version, according to an alternative embodiment of the technology described herein.
Figure 11:
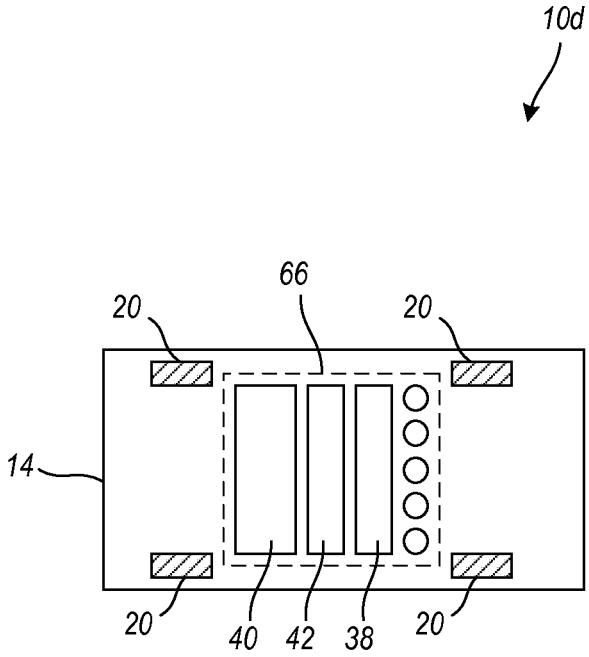
FIG. 11 is a bottom planar view of the ultrasonic floor cleaner and scrubber depicted in FIG. 10.
Figure 12:
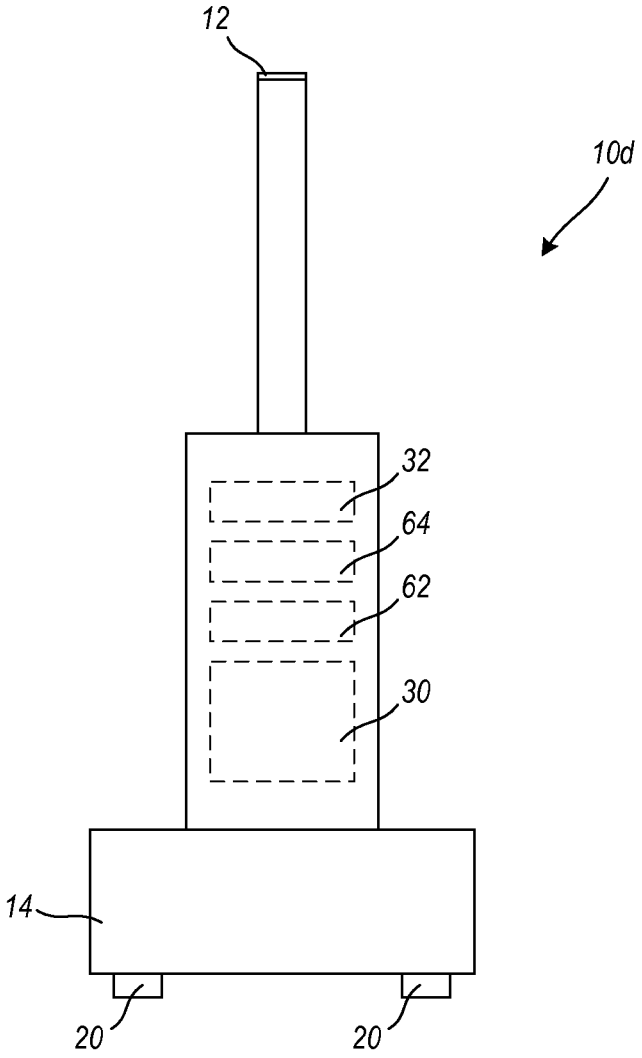
FIG. 12 is a front planar view of the ultrasonic floor cleaner and scrubber depicted in FIG. 10.

As depicted specifically in FIGS. 7 and 8, and in FIGS. 10, 11, and 12, a smaller, or mini, version of the ultrasonic floor cleaner and scrubber 10*b* is shown. Many of the elements of the 10*a* version are common, but have been made smaller to provide, for example, a residential version of the cleaner and scrubber.

The residential model should not encounter any environment that includes hazardous germs. The residential model is not recommended for commercial use. Periodic inspection, maintenance and cleaning by manual instructions will keep the residential model performing adequately. Self diagnostics will include onboard automatic self diagnostics capabilities such as ultrasonic wave equipment monitoring to insure optimum and safe performance. A controllable touch LCD screen mounted in the handle will display all functions and any performance, parts repair or replacement issues. This unit will have the same cleaning characteristics, steam and ultrasonic cleaning abilities.

In a lightweight residential model, such as 10*b* and 10*d*, the cleaner 10 is configured for hard surfaces and encompasses ultrasonic cleaning, steam application and bag less vacuuming techniques along with a detachable and washable cloth pad 66. The bag less vacuum uses a detachable container 30 for collection and disposing the trash and dirty solution. The detachable washable pad 66 will aid in providing a superior cleaning experience. Push button controls are located on the handle 12. The embodiment also includes an ultrasonic waveform generator 62 steam generator 64.

In use, the residential model cleaner 10*b* can be utilized, by way of example, as follows:

- All cleaners startup is accomplished by use of the handle mounted LCD touch screen. Power is provided by onboard retractable electrical cord or rechargeable batteries.
- Startup also includes a self diagnostics mode of all functions, after which the cleaner is ready.
- The cleaner's water, deodorant, bio-degradable cleaner reservoirs should be adequately filled with the required solutions.

The cleaner is an electrically operated, can be self propelled and tenant directed model. The unit is transported to a location to be cleaned. At the location, touch the start cleaning cycle icon; push the cleaner across the floor, covering the entire floor surface.

The hand wand is used for vertical surfaces. Start the hand wand function with the LCD touch screen. Move the hand wand in an up down pattern, covering the entire surface. When cleaning is finished, touch the hand wand stop icon on the LCD screen.

The waste liquids are retrieved from the waste container and properly disposed.

In use, the lightweight residential model cleaner 10*d* can be utilized, by way of example, as follows:

This model 10*d* uses the ultrasonic wave form, bag less vacuum suctioning and steam cleaning along with a detachable washable pad 66.

This model uses a wet solution cleaner.

This model can be used with the pad 66 or without the pad.

It is advisable to vacuum first without the pad 66. Then use the ultrasonic properties and suction. After which you would attach the pad and use the steamer and suction.

Figure 9:
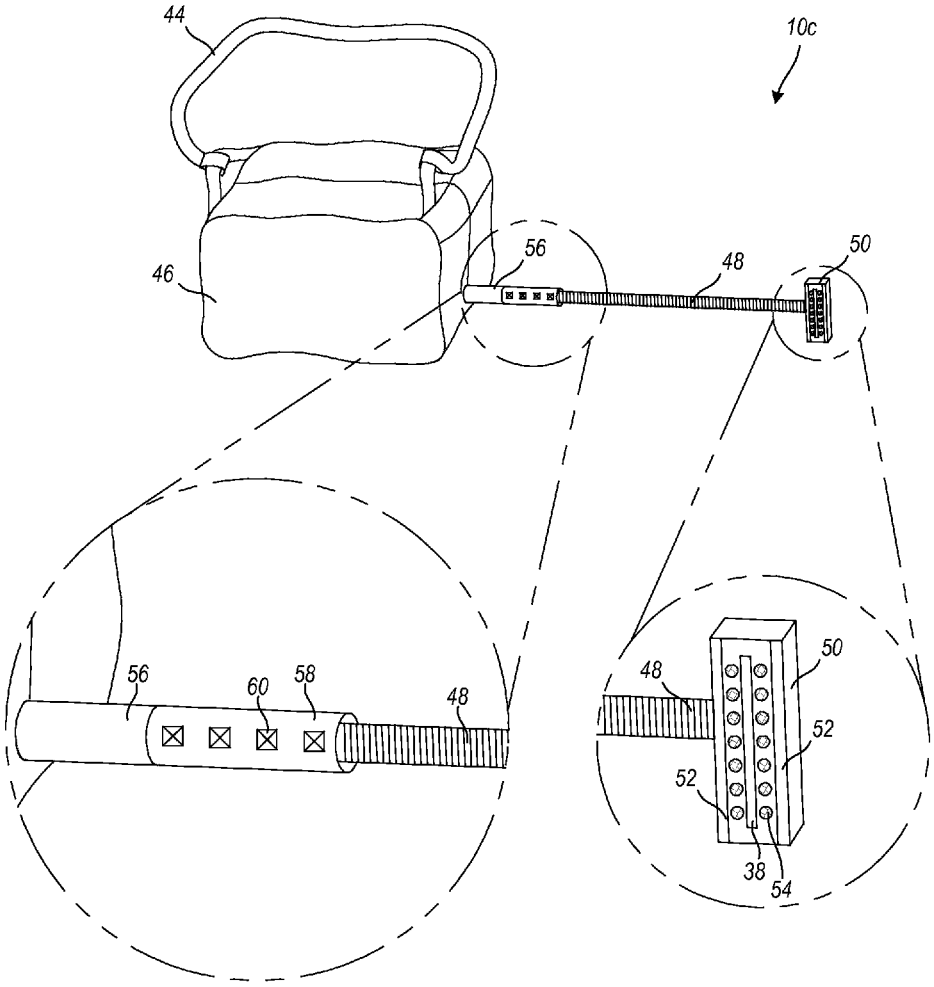
FIG. 9 is a front perspective view of an ultrasonic floor cleaner and scrubber, illustrating, in particular, an extendable hand wand and portable housing pack, according to yet another alternative embodiment of the technology described herein.

As depicted specifically in FIG. 9, a back pack portable cleaner and scrubber 10*c* is shown. Pack 46 contains the dispense reservoirs, various sprayer and suctions units, and steam generation units. The back pack portable cleaner and scrubber 10*c* is particularly useful in applications wherein portability is essential. By way of example, the back pack portable cleaner and scrubber 10*c* is useful in bioterrorism cleanup, the airline industry, EMT and ambulance services, educational programs on germ and disease outbreak, the cruise ship industry, hospital hazardous materials preparedness departments, and like applications.

This portable version is provided for field use. This unit will have the same cleaning characteristics, steam and ultrasonic cleaning abilities. There will be no onboard diagnostic features, due to its portability. This unit could also be disposed after use with proper disposal.

Pack 46 includes a portable power source. By way of example, the portable power source is a rechargeable battery pack. Alternative power sources can be utilized. By way of example, pack 46 can be coupled to a traditional power source in a building or home.

Pack 46 includes strap 44 with which the pack 46 is carried by an operator. This configuration is particularly useful in portability.

The backpack portable cleaner and scrubber 10*c* couples the pack 46 with a flexible hose 48 to hose head 50. The flexible hose head 50 includes an ultrasonic waveform emitter 38. The ultrasonic waveform emitter 38 provides ultrasonic waves to a surface at a user-selected frequency and at a user-selected intensity to vibrate the dispense liquid, once dispensed from a dispenser port, within and upon the surface to clean the surface.

The flexible hose head 50 also includes a multiplicity of nozzles 54. The nozzles 54 are utilized to disperse a cleaning agent, biodegradable cleaning solution, disinfectant, or the like, to a surface. The location and directional placement of the nozzles 54 can vary.

Hose head 50 also includes a multiplicity of suction ports 52. The suction ports 52 are utilized to reclaim any cleaning agents, or the like, as well as debris, pollutants, and the like.

The backpack portable cleaner and scrubber 10*c* a handle having a rigid grip 56. The handle also includes a semi-rigid portion 58 containing buttons 60 for controls and adjustments to operation of the back pack portable cleaner and scrubber 10*c*.

In use, the backpack portable cleaner and scrubber 10*c* can be utilized, by way of example, as follows:

Power is provided by rechargeable batteries or power cord to electrical source. All functions are controlled by push buttons located on the rigid portion of the grip. The back pack model can be used on horizontal and vertical surfaces. When finished, stop the cleaner with the push button controls.

The cleaner's water, deodorant, bio-degradable cleaner reservoirs should be adequately filled with the required solutions.

This could be a disposal model.

The waste liquids are retrieved from the waste container and properly disposed.

In use, the ultrasonic cleaner and scrubber 10, in these various embodiments, uses ultrasonic waves plus biodegradable cleaning solutions to provide superior cleaning action on all floor and other surfaces. In one version the ultrasonic cleaner and scrubber 10 has the ultrasonic emitter 38 positioned at the front bottom portion to loosen the dirt from the floor surface. The biodegradable cleaning solution release ports 34 are positioned after the ultrasonic emitter 38 on the bottom portion. The port for removal of the dirty solution is positioned at the back bottom portion of the ultrasonic cleaner and scrubber 10 and uses a combination of suction and rotating brush heads to remove the dirty solution into a first reservoir. The ultrasonic emitter 38 not only assists in removal of the dirt and grime, but also it is the first phase of sterilizing the floor surface; the biodegradable cleaning solution can be the second phase.

In an alternative embodiment of the ultrasonic cleaner and scrubber 10 a steam emitter 42 is used after the removal port to further sterilize the floor surface and a second removal port is positioned after the steam emitter 42 and is connected to either the first reservoir or to a second reservoir.

The placement of the ultrasonic emitter 38, cleaning solution release ports 34, first removal port, steam emitter 42, and second removal port and second reservoir may vary.

The ultrasonic emitter 38 may have a variable control/buttons to change the frequency/intensity of the ultrasonic waves being emitted based on floor characteristics, e.g. concrete, wood, granite, marble, carpet, etc.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the disclosed technology and are intended to be covered by the following claims.

What is claimed is:

1. An ultrasonic floor cleaner and scrubber comprising:

a housing;

a plurality of dispenser reservoirs disposed within the housing and configured to hold at least one dispense liquid;

a plurality of collection reservoirs disposed within the housing and configured to hold at least one collected liquid;

at least one dispenser port through which to dispense the held dispense liquid;

an ultrasonic waveform emitter disposed upon an underside of the housing to provide ultrasonic waves to a floor surface at a user-selected frequency and at a user-selected intensity to vibrate the dispense liquid, once dispensed from the dispenser port, within and upon the floor surface to clean the floor surface;

at least one suction and liquid and debris collection port;

a control panel handle disposed upon the housing and with which to hold and move the cleaner and scrubber and through which to access controls for use;

a first liquid retrieval assembly to remove major debris and liquids to a first collection reservoir of the plurality of collection reservoirs;

a second liquid retrieval assembly to remove remaining finer debris and liquids to a second collection reservoir of the plurality of collection reservoirs;

and a controller disposed on-board to process instructions and controls to the ultrasonic floor cleaner and scrubber.

2. The ultrasonic floor cleaner and scrubber of claim 1, further comprising:

a steam generation assembly disposed within the housing and configured to eject steam out at least one steam ejection port.

3. The ultrasonic floor cleaner and scrubber of claim 1, further comprising:

an agitation assembly disposed upon an underside of the housing to agitate the dispensed liquid within and upon the floor surface to clean the floor surface.

4. The ultrasonic floor cleaner and scrubber of claim 3, wherein the agitation assembly comprises a plurality of rotatable suction brush heads.

5. The ultrasonic floor cleaner and scrubber of claim 3, wherein the agitation assembly comprises a plurality of rollers.

6. The ultrasonic floor cleaner and scrubber of claim 1, wherein the dispense liquid is a biodegradable cleaning solution.

7. The ultrasonic floor cleaner and scrubber of claim 1, further comprising:

an extendable hand wand fluidly coupled to the ultrasonic floor cleaner and scrubber with which to clean and scrub surfaces other than those directly beneath the housing.

8. The ultrasonic floor cleaner and scrubber of claim 1, further comprising:

a power source; and a power level indicator.

9. A portable ultrasonic cleaner and scrubber comprising:

a transportable housing pack having a carrying strap to carry the pack and a battery pack power source disposed within;

at least one dispenser reservoir disposed within the housing pack and configured to hold at least one dispense liquid;

an extendable hand wand fluidly coupled to the housing pack with a flexible hose and through which the at least one dispense liquid travels;

at least one dispenser port disposed upon the end of the hand wand through which to dispense the dispense liquid;

an ultrasonic waveform emitter disposed upon an end of the hand wand to provide ultrasonic waves to a surface at a user-selected frequency and at a user-selected intensity to vibrate the dispense liquid, once dispensed from the dispenser port, within and upon the surface to clean the surface;

a pass-through adapter to fluidly couple the portable ultrasonic cleaner and scrubber to an external collection reservoir such that any liquid and debris reclaimed by the portable ultrasonic cleaner and scrubber by the suction and liquid collection port passes through to the external collection reservoir; and at least one suction and liquid and debris collection port disposed upon the end of the hand wand.

10. The portable ultrasonic cleaner and scrubber of claim 9, further comprising:

a steam generation assembly disposed within the housing pack and configured to eject steam out at least one steam ejection port upon the end of the hand wand.

11. The portable ultrasonic cleaner and scrubber of claim 9, further comprising:

a handgrip disposed upon the extendable hand wand, the handgrip having a plurality of controls by which to control the portable ultrasonic cleaner and scrubber and with which to adjust a plurality of configurable settings.

12. The portable ultrasonic cleaner and scrubber of claim 9, further comprising:

at least one collection reservoir disposed within the housing pack and configured to hold at least one collected liquid and debris.

13. The portable ultrasonic cleaner and scrubber of claim 9, further comprising:

a plurality of steam spray nozzles; and a plurality of disinfectant sprayer nozzles.

14. The portable ultrasonic cleaner and scrubber of claim 9, further comprising:

an agitation assembly disposed upon an underside of the extendable hand wand to agitate the dispensed liquid within and upon the surface to clean the surface.

15. An extendable hand wand for ultrasonic cleaning and scrubbing, the hand wand comprising:

a cleaning head disposed upon a distal end of the extendable hand wand, the extendable hand wand adapted for insertion into a sleeve on a portable ultrasonic cleaner and scrubber when not in use;

at least one dispenser port disposed upon the cleaning head through which to dispense a liquid;

at least one suction and liquid and debris collection port disposed upon the cleaning head;

an ultrasonic waveform emitter disposed upon the cleaning head to provide ultrasonic waves to a surface at a user-selected frequency and at a user-selected intensity to vibrate a cleaning solution within and upon the surface to clean the surface;

a plurality of steam spray nozzles; and a plurality of disinfectant sprayer nozzles.

16. The extendable hand wand of claim 15, further comprising:

an agitation assembly disposed upon an underside of the cleaning head to agitate the dispensed liquid within and upon the surface to clean the surface.

17. The extendable hand wand of claim 15, further comprising:

an adapter to fluidly couple the extendable hand wand to a cleaner and scrubber to provide ultrasonic cleaning and scrubbing from the extendable hand wand.

* * * * *